US007278601B2

(12) United States Patent
Xiaolin

(10) Patent No.: US 7,278,601 B2
(45) Date of Patent: Oct. 9, 2007

(54) SPEED-ADJUSTABLE LIFE-SAVING APPARATUS

(76) Inventor: Bai Xiaolin, No. 51 Changjiangdonglu, Deyang (CN) 618000

( * ) Notice: Subject to any disclaimer, the term of this patent is extended or adjusted under 35 U.S.C. 154(b) by 385 days.

(21) Appl. No.: 10/498,678

(22) PCT Filed: Dec. 11, 2002

(86) PCT No.: PCT/CN02/00885

§ 371 (c)(1),
(2), (4) Date: Oct. 18, 2004

(87) PCT Pub. No.: WO03/049807

PCT Pub. Date: Jun. 19, 2003

(65) Prior Publication Data

US 2005/0224616 A1 Oct. 13, 2005

(30) Foreign Application Priority Data

Dec. 11, 2001 (CN) ..... 01 1 29193

(51) Int. Cl.
*B65H 75/48* (2006.01)

(52) U.S. Cl. ..... 242/390.9; 242/420.5; 242/422.3; 182/72; 182/231; 182/236

(58) Field of Classification Search ..... 182/231, 182/236, 71, 72, 230; 242/420.5, 422.3, 242/390.9
See application file for complete search history.

(56) References Cited

U.S. PATENT DOCUMENTS 3,121,833 A * 2/1964 Conomos et al. ..... 318/145
3,541,414 A * 11/1970 Wilkerson ..... 388/804
4,448,284 A * 5/1984 Ciabo ..... 181/234
4,463,830 A * 8/1984 Geurtsen ..... 182/238
4,567,963 A * 2/1986 Sugimoto ..... 182/236
6,386,344 B1 * 5/2002 Hershtik ..... 188/268

FOREIGN PATENT DOCUMENTS

| | | |
|---|---|---|
| JP | 50-72495 | 9/1973 |
| JP | 49-120497 | 11/1974 |
| JP | 7-308394 | 11/1995 |
| JP | 53-8599 | 1/1998 |
| JP | 2000-134905 | 5/2000 |

* cited by examiner

*Primary Examiner*—Patrick Mackey
*Assistant Examiner*—Stefan Kruer
(74) *Attorney, Agent, or Firm*—Procopio, Cory, Hargreaves & Savitch LLP

(57) ABSTRACT

Provided is speed-adjustable life-saving apparatus which comprises a housing, a drum disposed in the housing, a life rope and a resistance wheel hub motor. One end of the life rope is fastened and wound on the drum. The resistance wheel hub motor disposed in the drum comprises a wheel hub, a speed-variable damper assembly, a shift and a rotor, and is supported in the housing by a main shaft. The wheel hub is fixedly connected to the drum and drives the rotor through the speed-variable damper assembly. A unilateral diode is connected to the circuit of the rotor through external leads. The speed-adjustable life-saving apparatus provided herein is safe, reliable and convenient to use.

9 Claims, 3 Drawing Sheets

SPEED-ADJUSTABLE LIFE-SAVING APPARATUS

This application is the U.S. national phase of international application PCT/CN02/00885 filed 11 Dec. 2002, which designated the U.S. and claims priority to CN Application No. 01129193.1 filed 11 Dec. 2001. The entire contents of these applications are incorporated herein by reference.

FIELD OF THE INVENTION

The present invention relates to life-saving apparatus, and more particularly for saving oneself or rescuing people in high-rise buildings during fire or following earthquake.

BACKGROUND OF THE INVENTION

Natural disasters, particularly fires or earthquakes, can cause substantial injuries to humans. For disasters occurring in high-rise buildings, life-saving equipment for use require the highest effectiveness and safety due to their special application, environment of use and shelf life. However, because conventional life-saving equipment used for high building rescues contain ineffective structures, personnel have difficulties in rescuing people from the high buildings during fire. This conventional life-saving equipment has the following disadvantages.

1. They generally make use of a frictional brake, which gives rise to a short service life and degraded reliability. As a result, they are suitable for use by professional firemen rather than by the untrained individuals for saving themselves.

2. The descending speed of the equipment is not adjustable. The speed increases as the body weight increases. As a result, it is disadvantageous to pass through the fire and rescue children. Also, they cannot stop in the air where necessary.

3. The descending speed of the human body is affected by the resistance generated between gears and ropes disposed between them. Because the ropes are made of steel covered by twines, the ropes are not fireproof and are not safe when passing through the fire.

4. As frictions occur when the ropes pass through the gears, the ropes are easy weakened and broken, which can decrease the resistant force resulting in the faster descending speed and degraded safety.

5. They need to be maintained and repaired regularly, resulting in a high level of availability for their use.

6. The height of application is limited (generally less than 100 m).

7. When used, two ropes move relatively and therefore it is easy to hurt users.

8. They are inconvenient to use because their main body is separated from the ropes.

SUMMARY OF THE INVENTION

Accordingly, an object of the present invention is to provide an speed-adjustable, safe, reliable and convenient to use life-saving apparatus that overcomes the above-mentioned shortcomings in the prior art.

To achieve the above-mentioned object, an speed-adjustable life-saving apparatus in accordance with the present invention is provided, which comprises a housing, a drum disposed in the housing and a life rope wound on the drum and fastened to the drum with one end. A resistance wheel hub motor is disposed in the drum comprising a wheel hub, a speed-variable damper assembly and a rotor, and is supported within the housing by a main shaft. The wheel hub is fixedly connected to the drum and drives the rotor after damping speed-up through the speed-variable damper assembly. A unilateral diode (D) is connected in a circuit of the rotor in series.

A load resistance is connected to the circuit of the rotor in series.

Two ends of the load resistance are connected with a speed-variable switch in parallel.

The load resistance is an adjustable resistance.

A plurality of unilateral diodes (D1~Dn) for changing voltage are connected to the circuit of the rotor in series.

Two ends of the unilateral diodes (D1~Dn) are connected with a speed-variable switch in parallel to change the number of the unilateral diodes connected in series.

The speed-variable damper assembly comprises a speed-variable bearing fixedly connected to the wheel hub, a damper bearing driven by the speed-variable bearing, and an eccentric shaft driven by the damper bearing. The eccentric shaft drives the rotor.

The speed-adjustable life-saving apparatus further comprises a back cover fixed to the main shaft, a supporting shaft disposed between the speed-variable bearing and the eccentric shaft through a rotating bearing, and a stator fixedly connected to the back cover and the supporting shaft.

The speed-adjustable life-saving apparatus further comprises a rope pullback assembly comprising a rope pullback opening, a larger gear and a smaller gear. The rope pullback opening disposed at the housing connects with the larger gear through bearings, and the larger gear drives the smaller gear disposed on the main shaft.

The speed-adjustable life-saving apparatus further comprises a safety lock assembly comprising a lockhole disposed at the housing, a manual rotating lockpin, an automatically centrifugal lockpin, a spring and a hollow lock block fixed at a side within the drum. One end of the spring is fixedly connected to the drum, another end thereof is connected with the automatically centrifugal lockpin disposed within the lock block, and the manpower lockpin can be inserted into the hollow lock block along the lockhole, if necessary.

With the above-mentioned technical solution, the advantages of the present invention are as follows:

1. The operation of the system is scientific, novel and creative. The life-saving apparatus of the invention can convert potential energy into mechanical energy and electromagnetic energy. A set of unilateral diodes for changing voltages and/or a load resistance for changing current are connected in the circuit of the rotor of the resistance wheel hub motor so that the descending speed can be adjusted. During the descent, the life-saving apparatus coverts the potential energy into the mechanical energy and electromagnetic energy. The mechanical energy drives the rotation of the motor generating current and creates a magnetic field, which generates a resistant force. The greater is the force applied to the wheel hub, the faster are its rotate speed and the resistant force generated by the rotor. Thus, a balance is achieved between the external force applied to the wheel hub and the resistant force generated by the rotor, thereby achieving the brake and allowing the wheel hub to rotate at a uniform speed.

2. The use of the motor brake is an advanced technology, which can increase safety and reliability in contrast with a conventional friction brake used in a life-saving apparatus.

3. The life-saving apparatus uses the body weight as power rather than electric power. The user can land at a prescribed safe speed (0.3-1.5 m/s) and then leave the site of the disaster.

4. The value of the load resistance for changing current and the number of the unilateral diodes for changing voltage can be adjusted so that the descending speed can be changed. The greater the value of the load resistance R, the faster is the descending speed. Contrarily, the lesser the value of the load resistance R, the slower is the descending speed. The larger the number of the connected unilateral diodes, the faster the descending speed is. Contrarily, the smaller the number of the connected unilateral diodes, the slower the descending speed is. Trained professionals can adjust the speed-variable switch to the faster shift, and pass through the fire safely, thereby shortening the descending time. Also, if necessary, the professionals can suspend the movement in the air by means of the safety lock assembly.

5. By the conversion of mechanical energy into electric energy, the shortcoming of the degraded safety and reliability due to the abrasions of the gears to the life rope existing in the conventional life-saving apparatus is overcome.

6. The life rope is made of stainless steel and therefore has a higher fireproof and can be used repeatedly in any direction.

7. It is not necessary to maintain the life-saving apparatus before use, and can be used in the environment of the rain or water.

8. The sample of the present invention has been produced. Each of its technical index has been inspected by the National Fire-fighting Apparatus Supervising & Inspecting Center of the Security Department, reached or surpassed the requirements of the quality standard.

9. With the automatically centrifugal lockpin technology, if the descending speed exceeds a safe range, the life-saving apparatus will brake to ensure the safety of the user.

Accordingly, the present invention provides speed-adjustable life-saving apparatus which is simple, subtle, safe, reliable and convenient.

DETAILED DESCRIPTION

Figure 1:
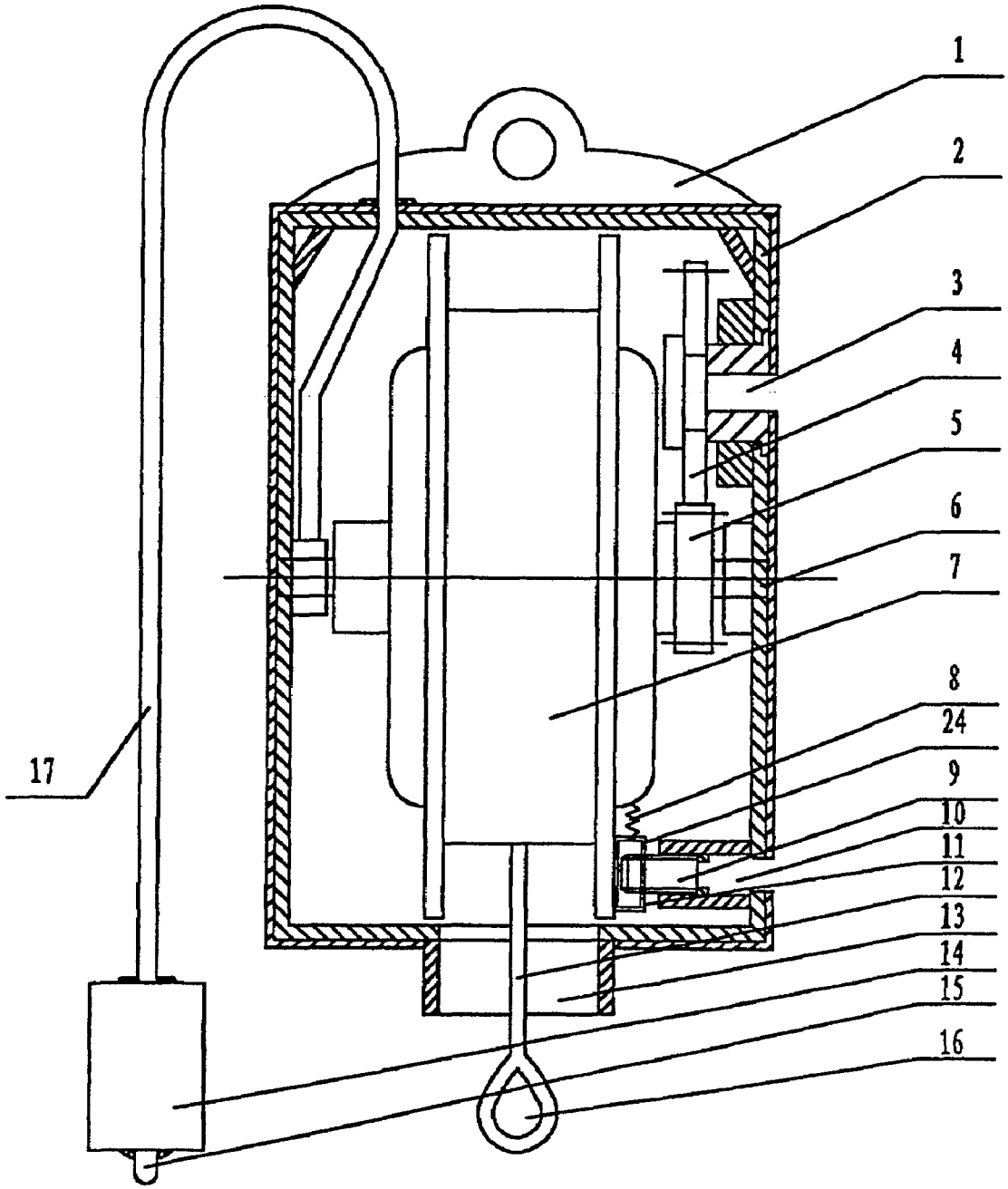
FIG. 1 is a schematic structure of an embodiment of a speed-adjustable life-saving apparatus in accordance with the present invention.

Referring to FIGS. 1 to 3*a*, an speed-adjustable life-saving apparatus in accordance with the present invention comprises a housing 2, a drum 7 disposed in the housing 2, a life rope 12, a resistance wheel hub motor disposed in the drum 7, a rope pullback assembly and a safety lock assembly. The housing 2 has a hanging unit 1 at the top and an opening 13 at the bottom. The life rope 12 is wound around the drum 7 and is fastened to the drum 7 at one end. Another end of the life rope 12 passes through the opening 13 to connect to a ring 16. The resistance wheel hub motor is supported in the housing 2 by a main shaft 6. The rope pullback assembly comprises a rope pullback opening 3, a larger gear 4 and a smaller gear 5. The rope pullback opening 3 disposed at the housing 2 is connected with the larger gear 4 through bearings. The larger gear 4 drives the smaller gear 5 disposed on the main shaft. The safety lock assembly comprises a lockhole 10 disposed at the housing 2, a manually-rotatable lockpin 9, an automatically centrifugal lockpin 24, a spring 8 and a hollow lock block 11 fixed at the side of the drum. The manual lockpin 9 is inserted into the hollow lock block 11 along the lockhole 10. One end of the spring 8 is fixedly connected to the drum 7, and another end thereof is connected to the automatically centrifugal lockpin 24 disposed within the lock block 11. When a wheel hub 38 rotates at a predetermined speed, the automatically centrifugal lockpin 24 departs from the lock block 11 due to centrifugal forces and locks the housing 2 fixedly connected with the main shaft 6. Thus, the rotation of the wheel hub 38 can be stopped, thereby achieving the purpose of the brake.

Figure 2:
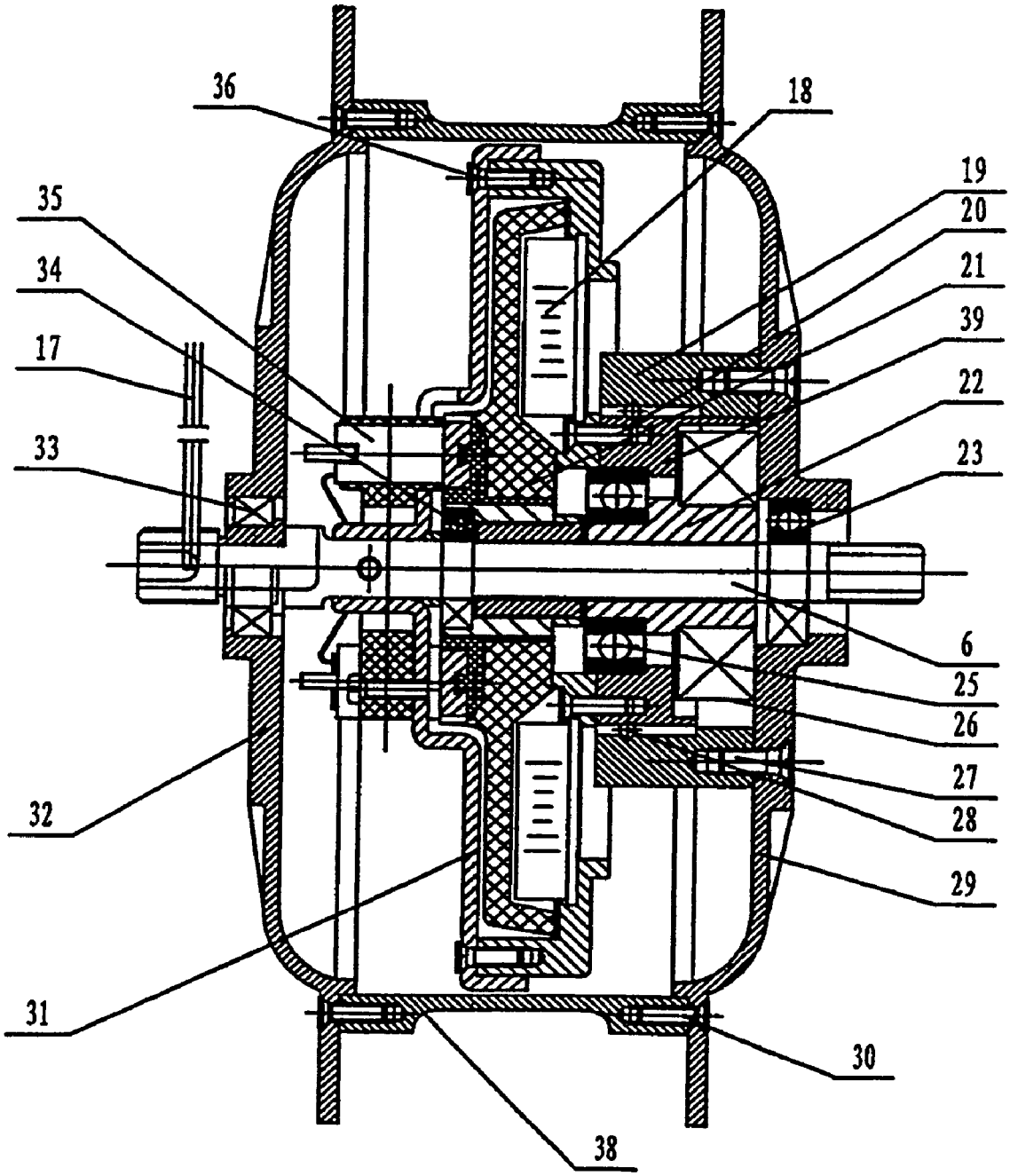
FIG. 2 is a schematically cross-sectional view of a resistance wheel hub motor of the speed-adjustable life-saving apparatus of FIG. 1.

As shown in FIG. 2, the resistance wheel hub motor comprises hub covers 29 and 32, the wheel hub 38, a back cover 31, a rotor 21, a stator 18, a speed-variable damper assembly, a supporting shaft 39, a commutating brush 35, external leads 17, a unilateral diode VD and an external load resistance R. The speed-variable damper assembly comprises a speed-variable bearing 19, a damper bearing 26 and an eccentric shaft 22. The wheel hub 38 is fixedly connected to the drum 7 and to the hub covers by screws 30. The hub covers 29 and 32 are supported on the main shaft 6 by bearings 23 and 33. The back cover 31 rivets on the main shaft 6. A bearing 34 and the rotatable eccentric shaft 22 are mounted on the main shaft 6. The commutating brush 35 is connected with the back cover 31 by screws. The supporting shaft 39 is fixed on a bearing 25 pressed into the eccentric shaft 22. The stator 18 is fixedly connected with the supporting shaft 39 and the back cover 31 by screws 20 and screws 36, respectively. The speed-variable bearing 19 is fixedly connected with the hub cover 29 by screws 27. A bearing 28 and the damper bearing 26 are disposed between the speed-variable bearing 19 and the supporting shaft 39, and between the speed-variable bearing 19 and the eccentric shaft 22, respectively. The rotor 21 is connected with the eccentric shaft 22 by screw threads. Windings of the rotor 21 and the commutating brush 35, the external leads 17, the unilateral diode VD and the external load resistance R form an electrical circuit of the rotor. Two ends of the external load resistance R are connected with a speed-variable switch 15(K). Both of the external load resistance R and the speed-variable switch 15 are disposed in a sleeve 14 of a speed adjustor.

The resistance wheel hub motor operates as follows. The wheel hub 38 rotates due to the external force. As its rotate speed increases due to the speed-variable bearing 19, the rotor 21, which is driven by the damper bearing 26, and the eccentric shaft 22 intersects the magnetic field of the stator 18 at a high speed. Thus, an electric current is generated in the circuit of the rotor formed by the commutating brush 35, the external leads 17 and the external load resistance R. The charged rotor 21 rotates in the magnetic field, which generates resistant forces. When a balance is achieved between the external force applied to the wheel hub 38 and the resistant force generated by the rotor 21, as well as the resistant force generated between the damper bearing 26 and the eccentric shaft 22, the wheel hub 38 rotates at a uniform speed. By adjusting the value of the load resistance R, the value of the current in the rotor circuit can be changed, thereby changing the resistant force of the rotor in the magnetic field. Thus, the rotate speed of the rotor can be changed, which in turn changes the speed of the wheel hub to effect control of the descending speed of the rope.

The greater the force applied to the wheel hub, the faster is its rotational speed, and the greater the resistant force generated between the damper bearing and the eccentric shaft. Meanwhile, the faster the rotate speed of the rotor, the greater is the current in the rotor circuit and the resistant force generated due to the intersection of the magnetic field lines by the rotor. A balance is thus achieved between the external force applied to the wheel hub and the resistant force generated by the rotor, as well as the resistant force applied to the eccentric shaft 22. During this process, the load resistance R converts part of the electric energy into the dissipated heat energy.

The larger the value of the load resistance R, the faster is the descending speed. Conversely, the lesser the value of the load resistance R, the slower the descending speed is. When the speed-variable switch 15 is closed, the load resistance R does not operate. In this event, only the internal resistance r of the rotor coil is present in the rotor circuit. As a result, the current in the circuit of the rotor is maximal, the resistant force generated by the incision of the magnetic field lines is maximal, and the descending speed is slowest.

If required, the load resistance R and the speed-variable switch 15 can be replaced with an adjustable resistance, such as a sliding resistance, which can be adjusted continuously to make the value of the load resistance in the circuit of the rotor changed easily. As a result, the rotate speed of the rotor can be adjusted to control the descending speed of the life rope.

Figure 3A:
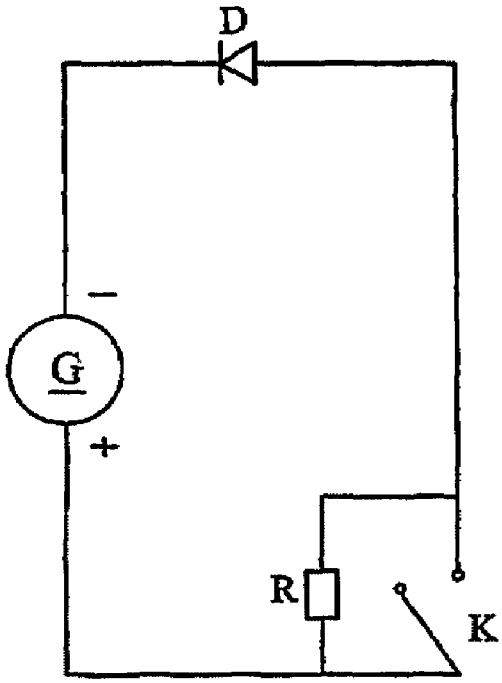
FIG. 3*a* is a circuit diagram of a circuit of the rotor of the resistance wheel hub motor of FIG. 2.
Figure 3B:
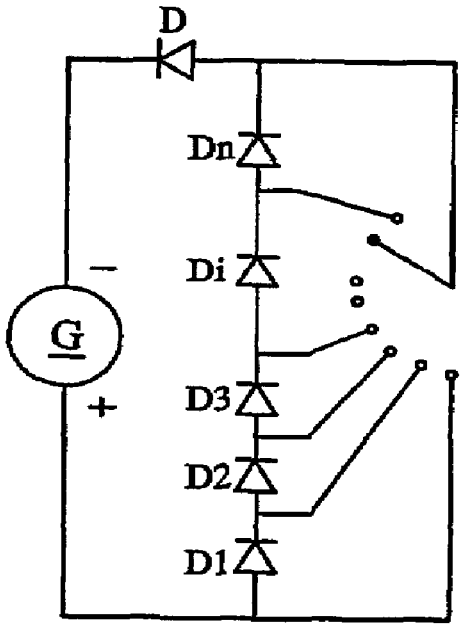
FIG. 3*b* is an alternative circuit diagram of a circuit of the rotor of the resistance wheel hub motor of FIG. 2.

As shown in FIG. 3*b*, there is provided another circuit diagram for adjusting the current in the circuit of the rotor of the resistance wheel hub motor. The load resistance R is replaced with a plurality of unilateral diodes (D1~Dn). The number of the connected unilateral diodes can be changed by the speed-variable switch 15. Therefore, there are different voltage drops with respect to different numbers of unilateral diodes to effect a change in the current value in the rotor circuit. The resistant force generated by the incision of the magnetic field lines changes accordingly, thereby adjusting the descending speed of the life rope. The larger the number of the connected unilateral diodes is, the faster descending speed is. Contrarily, the smaller the number of the connected unilateral diodes is, the slower the descending speed is.

The speed-adjustable life-saving apparatus of the present invention can substantially be used in such manners that it is fastened to a window of a building in emergency, hanged temporarily, and fastened to a platform at a higher altitude. Their usages are as follows, respectively.

Where it is fastened to the window in emergency, its usage comprises:

1) when a disaster occurs, opening the window, fixing the life-saving apparatus to a cantilever, and locking the safety lock of the life-saving apparatus;

2) extending the cantilevers out of the window;

3) putting on a safety belt under the armpits and suspending a safety hook of the safety belt to the ring of the life-saving apparatus;

4) grasping the safety belt, turning out the window, and put the body under the life-saving apparatus;

5) unlocking the safety lock, and landing on the ground safely (Where the life-saving apparatus is used by professionals, they can quickly pass through the fire or descend at a faster speed by adjusting the descending speed provided that the speed is slowed down when the distance away from the ground is 4 m.);

6) allowing hands or feet to contact the wall of the building in order to prevent the body from rotating during the descent; and 7) reducing the speed and then locking the safety lock where professionals use it and need to suspend in the air. to the ring of the life-saving apparatus;

After the users has landed, those remain at the upper floors can recover the life rope and the safety belt by a rockers for others' use. In such a manner, many persons can be rescued.

When trained professionals use the apparatus, they can first lock the apparatus and then suspend themselves in reverse so that they can slow down the speed when reaching 4 m away from the ground.

Where it is suspended temporarily, the apparatus is preferably affixed to a secured part of the building near a window or balcony (for example, pipes and frames of the door or the window) and connected to a safety belt.

Where it is fastened to a platform at a higher location, a stationary ring at the platform is preferably installed. In emergency, the life-saving apparatus is connected to the stationary ring.

Furthermore, the speed-variable damper assembly of the above embodiment comprising a speed-variable bearing, a damper bearing and an eccentric shaft can be replaced with other speed reducers (or transmissions) such as clutches and gears to control the descending speed.

The invention claimed is:

1. A speed-adjustable life-saving apparatus comprising:

a housing;

a drum rotatably disposed in the housing;

a life rope wound around the drum and fastened to the drum with one end;

a resistance hub motor being rotatably disposed in the drum and comprising a wheel hub, a rotor and a speed-variable damper assembly; and at least one unilateral diode electrically connected to the resistance hub motor; and wherein the speed-variable damper assembly comprises a speed-variable bearing, a damper bearing driven by the speed-variable bearing, and an eccentric shaft driven by the damper bearing, the wheel hub is fixedly connected to the speed-variable bearing, and the eccentric shaft drives the rotor.

2. The speed-adjustable life-saving apparatus of claim 1, wherein a load resistance is connected to the circuit of the rotor in series.

3. The speed-adjustable life-saving apparatus of claim 1, wherein a plurality of unilateral diodes (D1~Dn) for changing voltage are connected to the circuit of the rotor in series.

4. The speed-adjustable life-saving apparatus of claim 1, further comprising a back cover fixed to the main shaft, a supporting shaft disposed between the speed-variable bearing and the eccentric shaft, and a stator fixedly connected with the back cover and the supporting shaft.

5. The speed-adjustable life-saving apparatus of claim 2, wherein two ends of the load resistance connect with a speed-variable switch in parallel.

6. The speed-adjustable life-saving apparatus of claim 5, wherein the load resistance is an adjustable resistance.

7. The speed-adjustable life-saving apparatus of claim 3, wherein two ends of the unilateral diodes (D1~Dn) are connected with a speed-variable switch in parallel to change the number of the unilateral diodes connected in series.

8. The speed-adjustable life-saving apparatus of any one of claims 1 to 7, further comprising a rope pullback assembly comprising a rope pullback hole, a larger gear and a smaller gear, wherein the rope pullback hole disposed at the housing is connected with the larger gear through bearings, and the larger gear drives the smaller gear disposed on the main shaft.

9. The speed-adjustable life-saving apparatus of any one of claims 1 to 7, further comprising a safety lock assembly comprising a lockhole disposed at the housing, a manpower rotating lockpin, an automatically centrifugal lockpin, a spring and a hollow lock block fixed at a side within the drum, wherein one end of the spring is fixedly connected to the drum, another end thereof is connected with the automatically centrifugal lockpin disposed within the lock block, and the manpower lockpin can be inserted into the hollow lock block along the lockhole.

* * * * *